US007540035B1

(12) United States Patent
Bloom

(10) Patent No.: US 7,540,035 B1
(45) Date of Patent: Jun. 2, 2009

(54) SECURED BATH TOWEL FOR DRYING INFANTS

(76) Inventor: Janice T. Bloom, 750 E. 179th St., Apt. 6C, Bronx, NY (US) 10457

( * ) Notice: Subject to any disclaimer, the term of this patent is extended or adjusted under 35 U.S.C. 154(b) by 23 days.

(21) Appl. No.: 12/006,036

(22) Filed: Dec. 31, 2007

(51) Int. Cl.
*A41D 13/04* (2006.01)

(52) U.S. Cl. ..... 2/48; 2/51; 2/52

(58) Field of Classification Search ..... 2/48, 2/49.1–49.5, 51, 52, 46, 463, 464, 44, 45, 2/69, 69.5, 88, 92, 114, 308, 309, 311, 312, 2/323, 326–331, 104; 24/7, 9, 3.2; 224/257, 224/259, 267, 260, 160, 664, 647, 600, 602–605; 5/655

See application file for complete search history.

(56) References Cited

U.S. PATENT DOCUMENTS

| | | | | | |
|---|---|---|---|---|---|
| 147,264 | A * | 2/1874 | Hodgkins | 450/57 |
| 705,205 | A * | 7/1902 | Burgett | 2/327 |
| 731,759 | A * | 6/1903 | Dieter | 2/48 |
| 957,117 | A * | 5/1910 | Snow | 2/310 |
| 1,317,928 | A * | 10/1919 | Lobar | 2/327 |
| 1,592,283 | A * | 7/1926 | McKenzie | 2/48 |
| 1,632,873 | A * | 6/1927 | Bliss | 2/48 |
| 1,933,185 | A * | 10/1933 | Rouleau | 2/48 |
| 2,051,142 | A * | 8/1936 | Hovey | 2/48 |
| 2,629,871 | A * | 2/1953 | Greene | 2/51 |
| 2,706,817 | A * | 4/1955 | Schneider | 2/84 |
| 3,229,873 | A * | 1/1966 | Hershman | 224/160 |
| 4,402,440 | A * | 9/1983 | Purtzer et al. | 224/160 |
| 4,449,252 | A * | 5/1984 | Sullinger | 2/46 |
| 4,685,154 | A * | 8/1987 | Smith | 2/48 |
| 6,505,367 | B2 * | 1/2003 | Griffin et al. | 5/655 |
| 6,536,047 | B1 * | 3/2003 | Mullaly | 2/48 |
| 6,543,661 | B1 * | 4/2003 | Lazur | 224/604 |
| 6,594,829 | B1 * | 7/2003 | Turkheimer | 2/80 |
| 6,986,163 | B2 * | 1/2006 | Dugan | 2/69 |
| 7,174,570 | B2 * | 2/2007 | Dabney et al. | 2/48 |
| 2001/0034890 | A1 * | 11/2001 | Levas | 2/48 |
| 2004/0195283 | A1 * | 10/2004 | Zebraski | 224/259 |
| 2007/0017943 | A1 * | 1/2007 | Foy et al. | 224/153 |

* cited by examiner

*Primary Examiner*—Amy B Vanatta

(57) ABSTRACT

A secured towel arrangement is provided for drying an infant after bathing. This arrangement comprises a harness with two end looped bands and a resilient strap attached to the harness. The caregiver extends her arms through the bands and pulls the harness over and down her back. A drying towel having spaced apart fasteners on one surface is secured to the harness by attaching the fasteners on the towel to corresponding fasteners on the end bands of the harness.

A method is also provided for drying an infant after bathing using the secured towel arrangements of this invention.

3 Claims, 3 Drawing Sheets

SECURED BATH TOWEL FOR DRYING INFANTS

FIELD OF THE INVENTION

This invention relates to a method of drying infants after bathing using a towel secured to the caregiver, and is particularly related to the use of a towel secured to a harness worn around the caregiver's upper extremity, i.e., the chest. The invention is also related to a combined bath towel and harness with strap for securement to the caregiver for drying the infant after bathing.

BACKGROUND OF THE INVENTION

Safe securement of a baby after bathing is of paramount concern for mothers at home and for nurses in hospitals. Ordinarily after bathing, the baby is removed from the bathtub and wiped dry by a towel. The towel is usually gripped by the caregiver and is wrapped around the baby while the baby is held against the caregiver's chest. Thus the towel must be adequately secured in order to dry the baby safely and without incident.

Several prior art patents and publications have disclosed various methods of drying infants after bathing by protective towels which are secured to the body. For example, U.S. Pat. No. 4,685,154, issued Aug. 11, 1987 describes an apron and infant towel and a method of using the towel to dry an infant after bathing. The apron-towel has identical front and rear panels interconnected by shoulder straps. The infant is placed in the front panel, dried, and the back panel is brought directly over the caregiver's head to dry the infant. The method however is inconvenient and insecure.

U.S. Pat. No. 6,505,367 B2, issued Jan. 14, 2003, describes a bath towel device for picking up and drying an infant after bathing. The bath towel includes a strap for handing the towel around the neck of the caregiver and the towel is wrapped around the infant as shown in FIG. 3 of that patent.

U.S. Pat. No. 6,594,829 B1, issued Jul. 22, 2003, describes a protective towel wrap for drying infant, which has three components, a towel, a removable strap and a separate hat. The removal strap is wrapped around the neck of the caregiver.

The methods described in the prior art patents including the aforementioned patents, do not provide a truly secure and convenient means of drying infants.

Therefore, it is an object of the present invention to provide a towel in combination with a harness strap which can be safely secured to the front upper extremity of the caregiver's body for drying an infant after bathing.

It is also an object of the present invention to provide a method for drying an infant after bathing using the towel and harness with strap device which ensures safety and security of the infant while drying after bathing.

The foregoing and other features of this invention will be hereinafter described in detail in conjunction with the accompanying drawings which form parts of this application.

SUMMARY OF INVENTION

The present invention provides a secured towel for drying an infant after bathing. The towel can be secured to a harness worn by the caregiver. The harness has two opposed looped ends for extending the arms of a caregiver therethrough. A resilient stretchable strap having two ends is secured to the harness by attaching one end of the strap to the left band of the harness and attaching the other end of the strap to the right band of the harness. A fastener is position on the circumferential edge of each. A drying towel having two spaced apart fasteners (e.g., velcro patches) is secured to each velcro path on the bands of the harness.

In use, the caregiver extends her arms through the respective bands of the harness, secures the towel to the harness, and wraps the towel around the belly for drying after bathing.

In another variation of the invention, the harness is provided with criss-crossing members (straps) having its ends attached to the end bands of the harness as in the previous embodiment. An adjustable resilient strap with two ends, one end attached to the left band of the harness and the other end attached to the right band of the harness is adapted to be pulled over the head of the caregiver and pulled down to the back area. As in the previous embodiment a towel can be secured to the harness for drying the body after bathing.

DESCRIPTION OF THE DRAWINGS

In the drawings, wherein like reference numerals designate like parts.

DETAILED DESCRIPTION OF THE INVENTION

Figure 1:
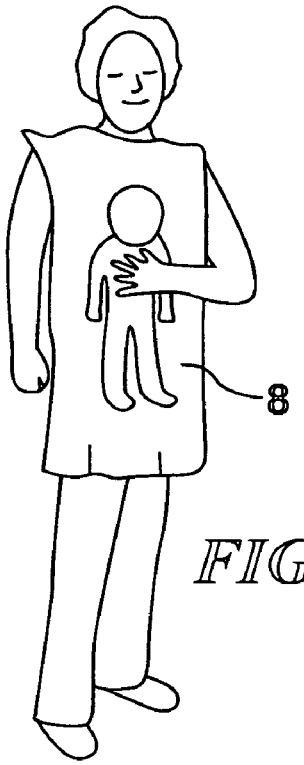
FIG. 1 is a front pictorial illustration of a caregiver, wearing a towel while holding an infant against the towel.
Figure 2:
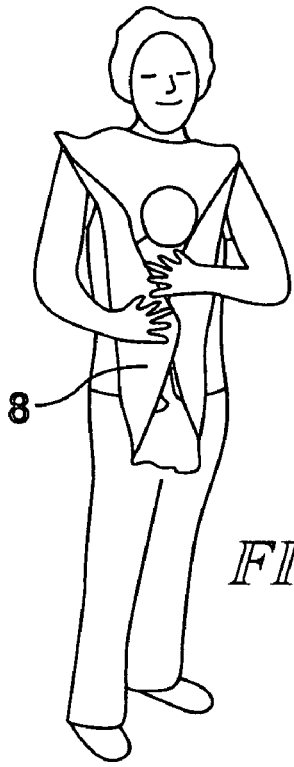
FIG. 2 is similar to FIG. 1 but shows the towel wrapped around the infant.
Figure 3:
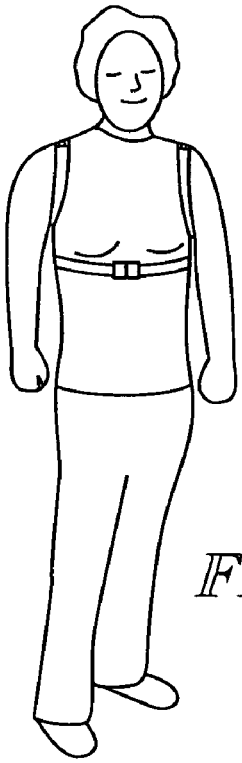
FIG. 3 is a front pictorial illustration showing a caregiver wearing a harness according to one embodiment of the present invention without a towel.
Figure 4:
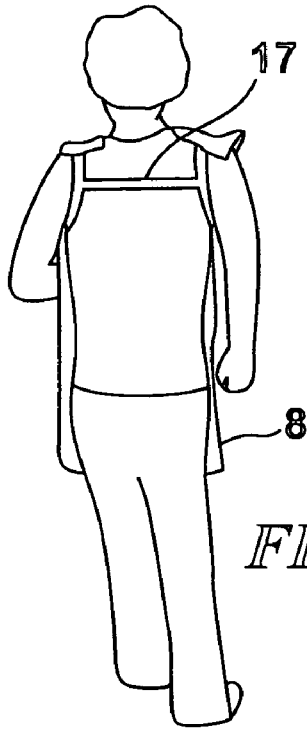
FIG. 4 is a rear pictorial illustration as in FIG. 3, showing the harness component from the rear according to the embodiment of the invention with the attached towel visible from the sides of the caregiver.
Figure 5:
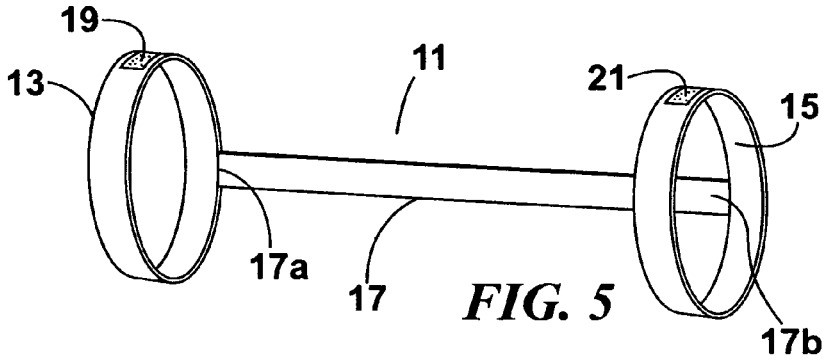
FIG. 5 is a front view of the harness and strap device according to one embodiment of the invention.
Figure 7:
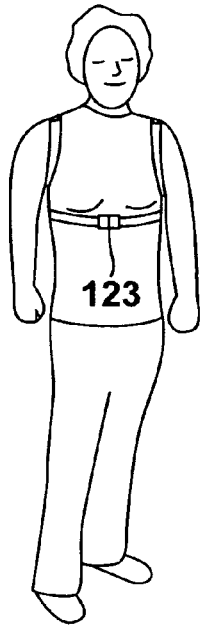
FIG. 7 is a view similar to FIG. 3 showing a strap attached to the harness.
Figure 8:
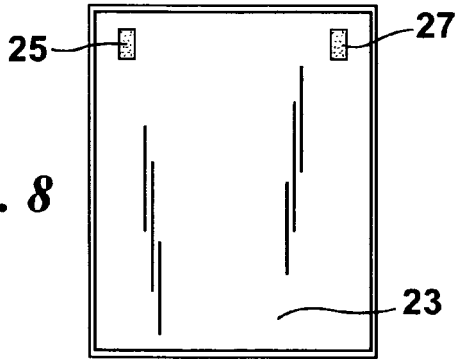
FIG. 8 is a front view of a typical drying towel used for attachment to the harness.

Referring to the drawings, there is shown in FIG. 5 the towel securement device 11 of one embodiment of this invention comprising laterally opposed end loop bands 13,15 connected to each other by means of a resilient stretchable strap 17 which may be sewn at each respective end as in 17*a*,17*b*. The stretchable strap 17 is sized to fit different torso sizes and the entire device may conveniently be made from a suitable material such as cloth or a fabric friendly to the human body. A fastener such as a velcro patch as the patches 19,21 can be affixed to the outer periphery of each band which serves to secure each band to a drying towel 23 having spaced apart velcro fasteners 25,27 as shown in FIG. 8. In use, the caregiver inserts and extends each arm through the appropriate band of the securement harness device with the strap 17 extending between the bands over the back as shown in FIG. 4. The drying towel is then wrapped around the infant as shown in FIG. 2 and the infant is dried after bathing. In FIGS. 3 and 7, there are shown an adjustable strap 29 around the lower chest (upper ribs) of the caregiver to provide additional securement means.

Figure 6:
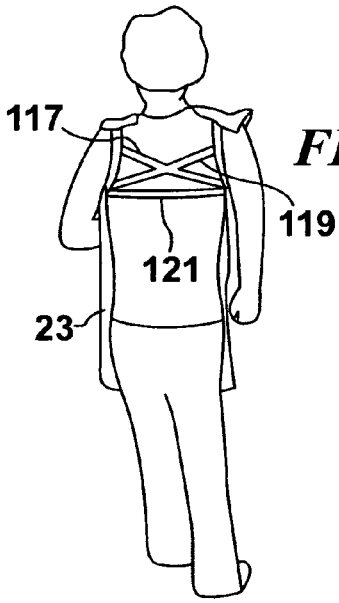
FIG. 6 is a view similar to FIG. 4 wherein the caregiver is wearing a harness in accordance with a different embodiment of the invention (see FIG. 9)
Figure 9:
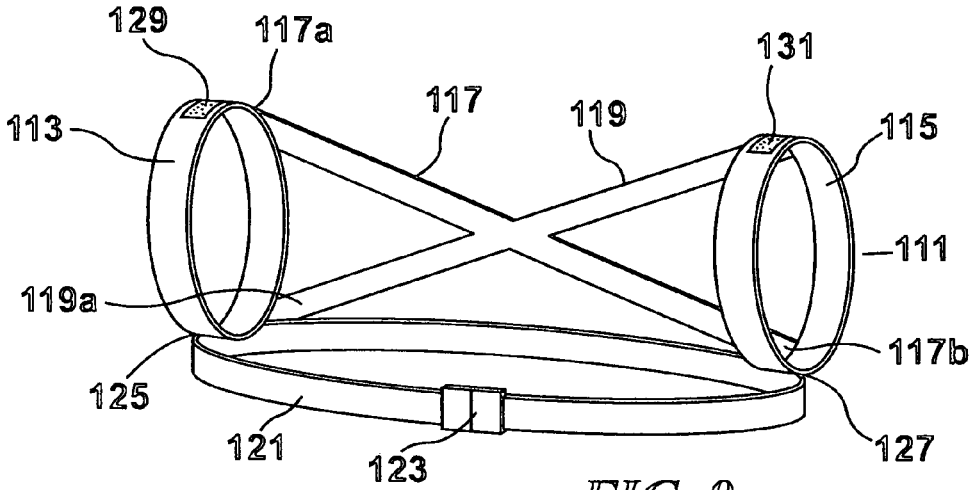
FIG. 9 is a front view of a looped harness bands with crisscrossing strap members and an adjustable strap, all as unitary structure, in accordance with another embodiment of the invention.
Figure 10:
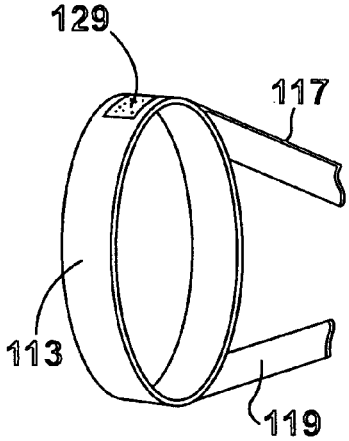
FIGS. 10, 11 and 12 illustrate one end loop band (left) of the harness, with circumferentially placed securement means (e.g., velcro patch) for securement of the towel to the end band, the opposite end band having the same construction as left band.
Figure 11:
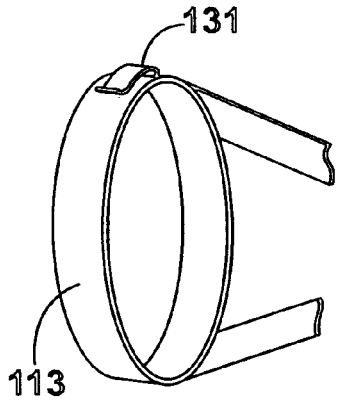
Figure 12:
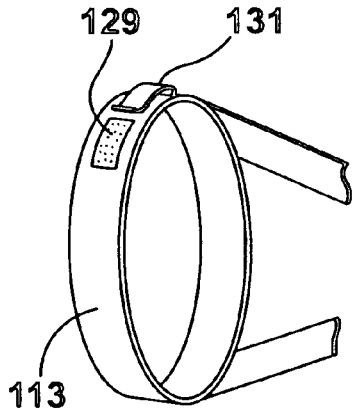

Another embodiment of the invention shown in FIGS. 9 and 6 is designed to provide improved securement and assure additional safety during drying of an infant after bathing. Thus referring to FIG. 9 the securement device 111 comprises opposed lateral end loop bands 113,115, crisscrossing stretchable members (straps) 117,119 and an adjustable strap 121 having a means 123 for adjusting the tension of the strap 121 to fit the torso size. The strap 117 has one end as in 117*a* attached to the outer periphery of the loop band 113 and its other end 117*b* attached to the outer periphery of the loop band 115. Similarly, the other cross-crossing strap 119 has one end 119*a* attached to the outer periphery of the loop band 113 and its other end 119*b* attached to the outer periphery of the loop hand 115. The straps 117,119 may be secured to the end loop band 113 by sewing or any other suitable fastener means and, similarity, the adjustable strap 121 may be securely sewn to the end loop bands as shown at 125,127. Fastening means such as velcro patch 129 (FIG. 10), a fastening clip 131 (FIG. 11), and velcro patch 129, and a fastening clip 131 (FIG. 12) provided on the outer periphery of each of the bands 113,115 are provided for securing the drying towel. Thus, the device shown in FIG. 9 is a one-piece unitary structure ready to be worn by the caregiver.

In use, the caregiver inserts and extends her arms through the respective end bands 113,115 and pulls the criss-crossing straps 117,119 over her back as shown in FIG. 6. The adjustable strap is then tightened around the back by adjusting means 123 to fit comfortably. The towel is then fastened by attaching each velcro patch 25,27 of the towel 23 to the velcro patches 131 located on the outer surface of each band (113, 115). The drying towel is now secured and can be safely wrapped around the infant by the caregiver and the infant dried as in the previous embodiment.

Thus, the present invention provides a toweling arrangement and method for drying an infant after bathing which affords comfort to the caregiver that the towel and the attached harness are safely secured to the caregiver during drying the infant. The harness can be worn and the towel attached readily, secured with ease, and after use it can be removed easily and re-used if desired.

As it can be appreciated from the foregoing detailed description several changes and modifications may be made which are suggested from said description and are obvious therefrom. Also, while the towel securement device is described for use to dry infants after bathing, it can also be used for drying pets in a similar manner.

The invention claimed is:

1. A secured towel arrangement for drying an infant after bathing comprising:

a harness having two spaced apart end looped bands, a left end band and a right end band, a stretchable resilient strap having two ends, one of said ends attached to the left band of said harness and the other of said ends attached to the right band of the said harness, a fastener means positioned on each of said bands of said harness, a drying towel having a front surface and a rear surface and two spaced apart fasteners on one of said surfaces wherein each of said fasteners on said towel is adapted to engage a fastener means on each band of said harness.

2. A secured towel arrangement for drying an infant after bathing comprising:

a harness having two spaced apart end loop bands, a left end band and a right end band, two criss-crossing resilient stretchable members, one of said members having two ends, one end attached to said left band and a second end attached to said right band, the other criss-crossing member having two ends, one end attached to said left band and the other end attached to said right band, a resilient strap having two ends, a left end attached to said left band and a right end attached to said right band, said resilient strap adapted to be pulled over and down over the back of a caregiver and said resilient strap being adjustable to fit comfortably around the torso of said caregiver, a fastener positioned on each of said bands of said harness, a drying towel having a front surface and a rear surface and two spaced apart fasteners on one of said surfaces wherein each of said fasteners on said towel is adapted to engage the fastener on each band of said harness.

3. A method of drying an infant after bathing using a secured drying towel, which comprises:

using a harness having two opposed end looped bands and a resilient stretchable strap having two ends, one end attached to one end band of said harness, and the other end attached to the other end band of said harness, wearing the harness by inserting the left arm of a caregiver through the left band, and the right arm of the caregiver through the right band, securing a drying towel to said harness, wrapping said towel around the infant after bathing and drying said infant.

* * * * *